US006135902A

United States Patent [19]

Nunez

[11] Patent Number: 6,135,902

[45] Date of Patent: Oct. 24, 2000

[54] MALLET AND METHOD OF BALANCING POLO MALLETS

[76] Inventor: Juan Nunez, 10838 Bal Harbor Dr., Boca Raton, Fla. 33498

[21] Appl. No.: 09/187,516

[22] Filed: Nov. 5, 1998

[51] Int. Cl.[7] ..... A63B 59/16

[52] U.S. Cl. ..... 473/558

[58] Field of Search ..... 473/558, FOR 191, 473/518, 519, 551, 568

[56] References Cited

U.S. PATENT DOCUMENTS

| | | | |
|---|---|---|---|
| 1,541,736 | 6/1925 | Overin | 473/558 |
| 4,516,774 | 5/1985 | Nankivell | 473/518 |
| 4,964,192 | 10/1990 | Marui | 473/551 |
| 5,951,418 | 9/1999 | Atkinson | 473/558 |

FOREIGN PATENT DOCUMENTS

| | | | |
|---|---|---|---|
| 8017 | 4/1902 | United Kingdom | 473/FOR 191 |
| 16597 | 5/1908 | United Kingdom | 473/FOR 191 |
| 320420 | 10/1929 | United Kingdom | 473/FOR 191 |

*Primary Examiner*—Mark S. Graham
*Attorney, Agent, or Firm*—Robert M. Downey, P.A.

[57] ABSTRACT

A grip for a polo mallet is integrally formed of a composite, shock absorbing material and includes a longitudinal bore extending between a proximal end and a distal end, and a knob formed on the proximal end zone. One or more chambers are provided for receipt of weight elements within the grip in order to selectively balance the polo mallet in accordance with a player's specifications. In one embodiment, a spring clip removably attaches a hand strap to the grip, adjacent the knob. In another embodiment, the hand strap includes a closed loop portion and a free extension fitted through a strap holder on one side of the grip and releasably attachable to the loop to adjustably tighten the hand strap about the player's hand. The head of the mallet may be wrapped with a layer of ballistic material to increase its hardness. A method of balancing the polo mallet is also disclosed.

2 Claims, 5 Drawing Sheets

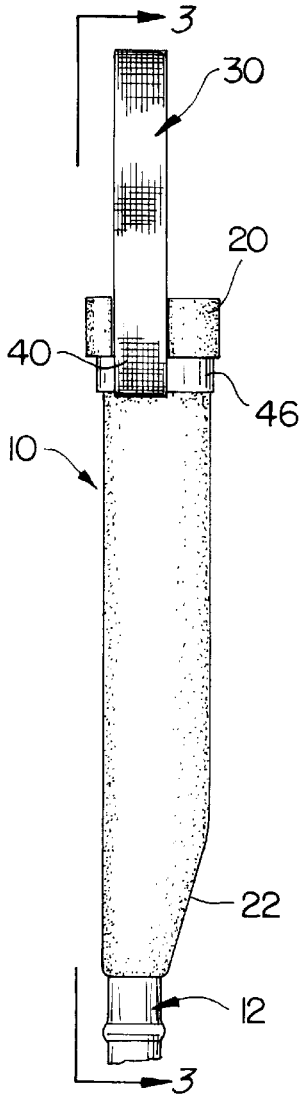
FIG. 2
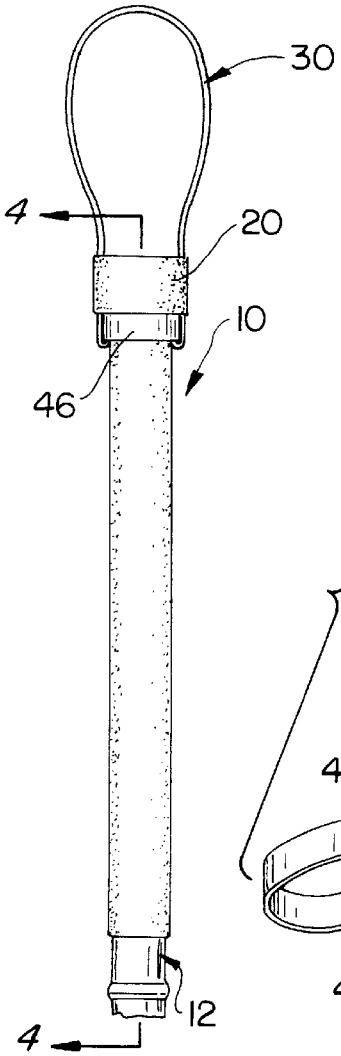
FIG. 3
FIG. 5
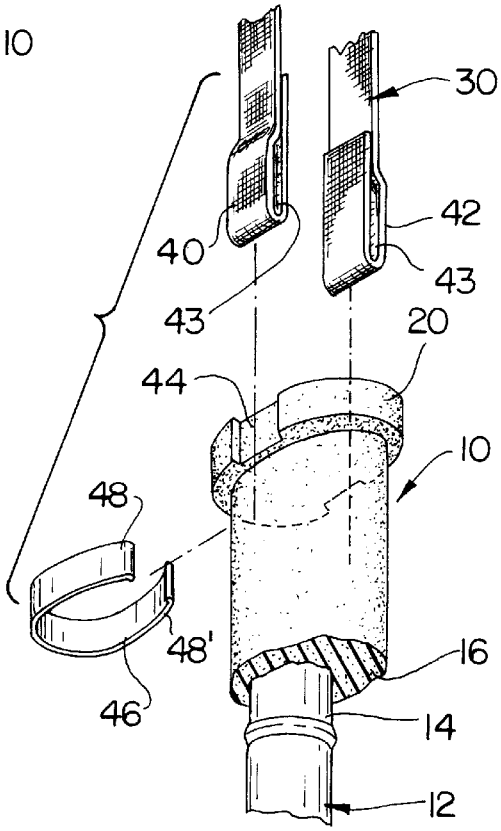
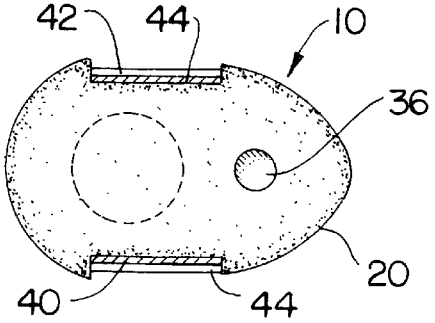
FIG. 6
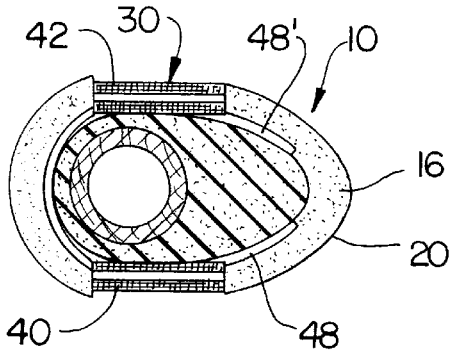
FIG. 7

MALLET AND METHOD OF BALANCING POLO MALLETS

BACKGROUND OF THE INVENTION

1. Field of the Invention

The present invention relates to a grip for a polo mallet and, more particularly, to a shock absorbing grip for a polo mallet integrally formed of composite materials and including a hand strap with means for removably attaching the hand strap to the grip and means for balancing the polo mallet in accordance with an individual player's specifications.

2. Description of the Related Art

The sport of polo, having a history rich in tradition, has seen few changes over its hundreds of years of existence and the design of the polo mallet is no exception. The traditional polo mallet includes a head carved from a hard wood for striking a ball and a cane (shaft) having one end fixed to the head. The traditional polo mallet further includes a handle or grip formed of one or more pieces of hard wood which are shaped to a traditional configuration, including a knob at one end. The grip is fixed to the opposite end of the cane using nails. A hand strap is nailed at opposite ends to the grip to form a closed loop which is wrapped about the player's hand when gripping the mallet.

Despite the longevity and tradition associated with the conventional polo mallet, there remain some drawbacks due to the materials and antiquated methods of construction. In particular, the handle or grip of the traditional polo mallet, being made of hard wood, is unable to absorb vibration which travels from the head and up the shaft of the mallet. For this reason, most polo players wear gloves to minimize the discomfort of vibrations. Furthermore, it is not uncommon for the hand strap to break during the course of a polo match. This requires removal of the nails holding the broken strap and replacement of a new hand strap which is again nailed to the handle. This repeated nailing of hand straps to the handle results in weakening of the cane. Further, the nail holes expose the interior of the cane to humidity and dryness in the atmosphere which damages and weakens the cane shaft.

The most significant problem associated with the use of natural materials in the construction of polo mallets is the lack of uniformity among a player's collection of mallets due to the varying characteristics of natural materials, and particularly natural cane.

It is, therefore, difficult for a player to find several polo mallets which meet the player's ideal specifications. For instance, the size (diameter) of the cane shaft at the top or proximal end will affect the size of the grip. Once a player has become comfortable with the feel of a particular grip size, any variation in size on other mallet grips tends to feel awkward. The varying characteristics of natural cane also results in differences in shaft lengths, flexibility and balance. Many polo players find it difficult to adjust to any change in the feel and performance of different mallets particularly during a game. And, because mallets are often damaged, it is not uncommon for a player to use several mallets during the course of one polo game. In fact, most professional polo players maintain a supply of at least ten polo mallets which are ready for use during a game. Ideally, all of the player's mallets should have the same specifications, much like a professional tennis player is able to maintain a supply of rackets with identical specifications or a baseball player with a collection of identical bats. Unfortunately, duplication is far more difficult to achieve in the construction of polo mallets, particularly when using natural cane shafts. And, while composite material shafts, such as graphite, would make it easier to reproduce the desired specifications, most polo players, having become accustomed to the feel experienced with natural cane on traditional mallets, find it difficult to adapt to the distinctive change in feel and increased vibration produced by composite material shafts.

Accordingly, there exists a need for a polo mallet grip which addresses the need for uniformity in view of the varying characteristics of natural cane shafts. There is a further need for a system or method of balancing polo mallets to meet the specifications and needs of individual players, so that a polo player can keep a large number of polo mallets available, all having the identical feel, balance and flexibility.

SUMMARY OF THE INVENTION

The present invention is directed to an improved polo mallet, and particularly to: a uniform, shock absorbing grip; a removable and adjustable hand strap; a mallet head having increased hardness and a method of balancing polo mallets according to the individual specifications of polo players. The grip is integrally formed of a composite, shock absorbing material and includes a longitudinal bore extending between a proximal end and a distal end. The grip is molded about the end of the shaft and bonds thereto, thus eliminating the need to drive nails into the cane shaft. In a preferred embodiment, the grip is formed of polyurethane foam and is molded about the shaft with the end of the shaft fitted within the mold. This allows for varying sizes (shaft diameters) of natural cane, while achieving a uniform grip size and feel which can be repeatedly duplicated from an all cane shaft, as well as graphite. A knob is formed on the proximal end zone and includes a shoulder at the juncture between a grip area and the proximal end zone. One or more chambers are provided for receipt of weight elements within the hand grip in order to selectively balance the polo mallet in accordance with a player's specifications. In one embodiment, a spring clip removably attaches a hand strap to the grip, adjacent the knob. In another embodiment, the hand strap includes a closed loop portion and a free extension fitted through a strap holder on one side of the grip and releasably attachable to the loop to adjustably tighten the hand strap about the player's hand. The head of the mallet may be wrapped with a layer of ballistic material to increase its hardness. Finally, a method of balancing the polo mallet is disclosed and includes the steps of: determining an overall weight and balance point along the shaft of a first polo mallet which meets an individual's players specifications; selecting additional polo mallets to be balanced; weighing the additional polo mallets to determine a total amount of weight to be added to equal the first polo mallet; adding the weight to the additional polo mallets to move the balance point until it matches the specification balance point.

With the foregoing in mind, it is a primary object of the present invention to provide a grip and balancing method which provide uniformity to a plurality of polo mallets to thereby accommodate the individual needs and specifications of polo players.

More specifically, it is a primary object of the present invention to provide uniformity to all of one's polo mallets so that an individual polo player can maintain a supply of polo mallets all having identical specifications including overall weight, balance, length, flexibility and feel.

It is a further object of the present invention to provide a grip for polo mallets which is structured for use on both traditional polo mallets made of cane, as well as polo mallets using composite material shafts such as graphite and fiberglass.

It is a further object of the present invention to provide a grip for polo mallets which is specifically structured to absorb shock from vibrations in the shaft of the polo mallet.

It is still a further object of the present invention to provide a grip for polo mallets which provides for selective weight adjustment and balancing of the polo mallet.

It is still a further object of the present invention to provide a grip for polo mallets which is adapted to provide a softer feeling which allows a polo player to use a polo mallet without gloves.

It is still a further object of the present invention to provide a grip for polo mallets which includes a hand strap which removably attaches to the grip without the use of nails, thereby avoiding weakening of the cane.

It is still a further object of the present invention to provide a hand strap which removably attaches to the grip of a polo mallet and wherein the hand strap includes means for adjustably tightening the strap about the player's hand in order to remove slack.

It is yet a further object of the present invention to provide a hand strap for removable attachment to the grip of a polo mallet, wherein the hand strap is specifically structured to be easily and quickly removed from the grip when changing mallets, so that the hand strap can remain on the player's hand.

It is a yet further object of the present invention to provide a hand strap for removable attachment to the grip of a polo mallet, wherein the hand strap is specifically structured to wrap around the hand of the player without introducing a twist in the strap.

It is still a further object of the present invention to provide a grip for polo mallets including one or more cavities formed at select, strategic areas of the grip, wherein the cavities are specifically structured for receipt of weights therein to permit the balance of the polo mallet to be altered and adjusted in accordance with a player's specifications.

It is still an object of the present invention to provide a grip for polo mallets which is adapted to receive any conventional over wrap, such as that used on tennis racquets, in a manner which is easy to change by the polo player.

It is yet a further object of the present invention to provide an improved head on a polo mallet having increased hardness to thereby minimize absorption upon impact with a ball to thereby increase the distance of travel of the ball.

It is still a further object of the present invention to provide a method of balancing polo mallets so that a plurality of polo mallets can be balanced to the specifications of a polo player, thereby providing a supply of polo mallets to a player, wherein all of the polo mallets have the same weight and balance.

It is still a further object of the present invention to provide a method of balancing a polo mallet to provide a bigger sweet spot on the head when striking a ball.

It is yet a further object of the present invention to provide a method of balancing a polo mallet which results in less torque when the ball has been hit off center on the head.

It is still a further object of the present invention to provide a method of balancing a polo mallet which results in more accurate shots when striking a stationary ball (e.g., penalty shots), and which further results in more distance of the ball traveling in the air and on the roll, after the ball has landed.

These and other objects and advantages of the present invention will be more readily apparent with reference to the following detailed description and the accompanying drawings.

BRIEF DESCRIPTION OF THE DRAWINGS

For a fuller understanding of the nature of the present invention, reference should be made to the following detailed description taken in conjunction with the accompanying drawings in which:

FIG. 2 is a side elevational view of the grip;

FIG. 3 is a front elevational view of the grip;

FIG. 5 is an exploded perspective view of the knob end of the grip showing attachment of a hand strap thereto in accordance with one embodiment;

FIG. 6 is a top plan view of the knob end taken along the plane of the line 6—6 of FIG. 4;

FIG. 7 is a sectional view taken along the plane of the line 7—7 of FIG. 4;

Like reference numerals refer to like parts throughout the several views of the drawings.

DETAILED DESCRIPTION OF THE PREFERRED EMBODIMENTS

Figure 1:
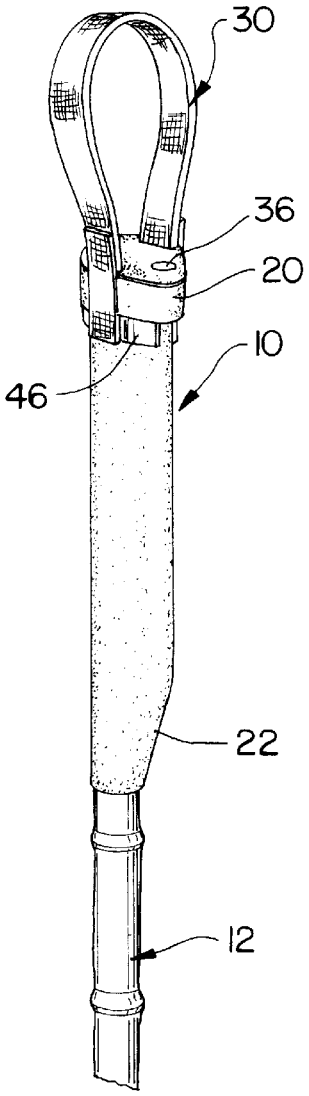
FIG. 1 is a perspective view of the polo mallet grip of the present invention.

Referring initially to FIGS. 1–7, a grip on the shaft of a polo mallet is shown in accordance with a preferred embodiment of the present invention, and is indicated generally as 10. The grip is formed of a lightweight, somewhat resilient composite material which is able to be molded to the proximal end zone 14 of a polo mallet shaft 12. In the preferred embodiment, the grip 10 is formed of a polyurethane foam 16 and is molded about the proximal end zone 14 of the shaft 12 to produce a uniform exterior configuration. In manufacture, the proximal end zone of the shaft is positioned and supported within a grip mold and, thereafter, the polyurethane foam, or other composite material, is introduced into the mold. Upon curing, the polyurethane foam material bonds to the shaft to become integral therewith, producing the molded grip 10 on the proximal end zone of the shaft. The grip is molded in accordance with the conventional configuration of a grip found on traditional polo mallets. However, unlike traditional mallets, the molded grip of the present invention can be replicated to meet exact size specifications regardless of the variations in size of the natural material cane shaft 12. Thus, a plurality of polo mallet shafts (natural or man-made) can be fitted with the grip 10 of the present invention, producing the identical feel when gripped by the player. Much like the traditional grip, the butt end (proximal end) of the grip includes an enlarged knob 20, while the opposite end portion 22 is tapered along the bottom, towards the shaft. The material used to form the grip provides slight resiliency which relieves stress on the hand at pressure points, particularly when striking the ball. The grip material also absorbs shock vibrations which travel up the shaft, from the head, as a result of impact with the ball or the ground.

The improved polo mallet of the present invention further includes a hand strap 30 which removably attaches to the grip 10. This allows the hand strap 30 to be quickly detached from the polo mallet when it is necessary to change mallets or to quickly replace the hand strap if it becomes damaged. The means of removably attaching the hand strap to the grip avoids the use of nails, thereby protecting the shaft from weakening, while also protecting the shaft from natural elements (e.g., humidity or dryness). A longitudinal bore 36 may be formed into the grip, at the proximal end, for receipt of a weight element 38 when balancing the polo mallet, as described more fully hereinafter.

In one embodiment, the hand strap 30 includes opposite ends 40, 42 formed in a loop 43, as best seen in FIG. 5. Notches 44 are provided on opposite sides of the knob 20 to accommodate the strap. The loops 43 are placed below the knob, on opposite sides of the grip, and a spring clip 46 is fitted about the grip so that arms 48, 48' of the spring clip pass through the looped ends of the strap. The spring clip is specifically sized and configured for snug fit about the grip, with the arms 48, 48' being urged inwardly to hold the opposite ends of the hand strap tightly against the exterior surface of the grip.

Figure 8:
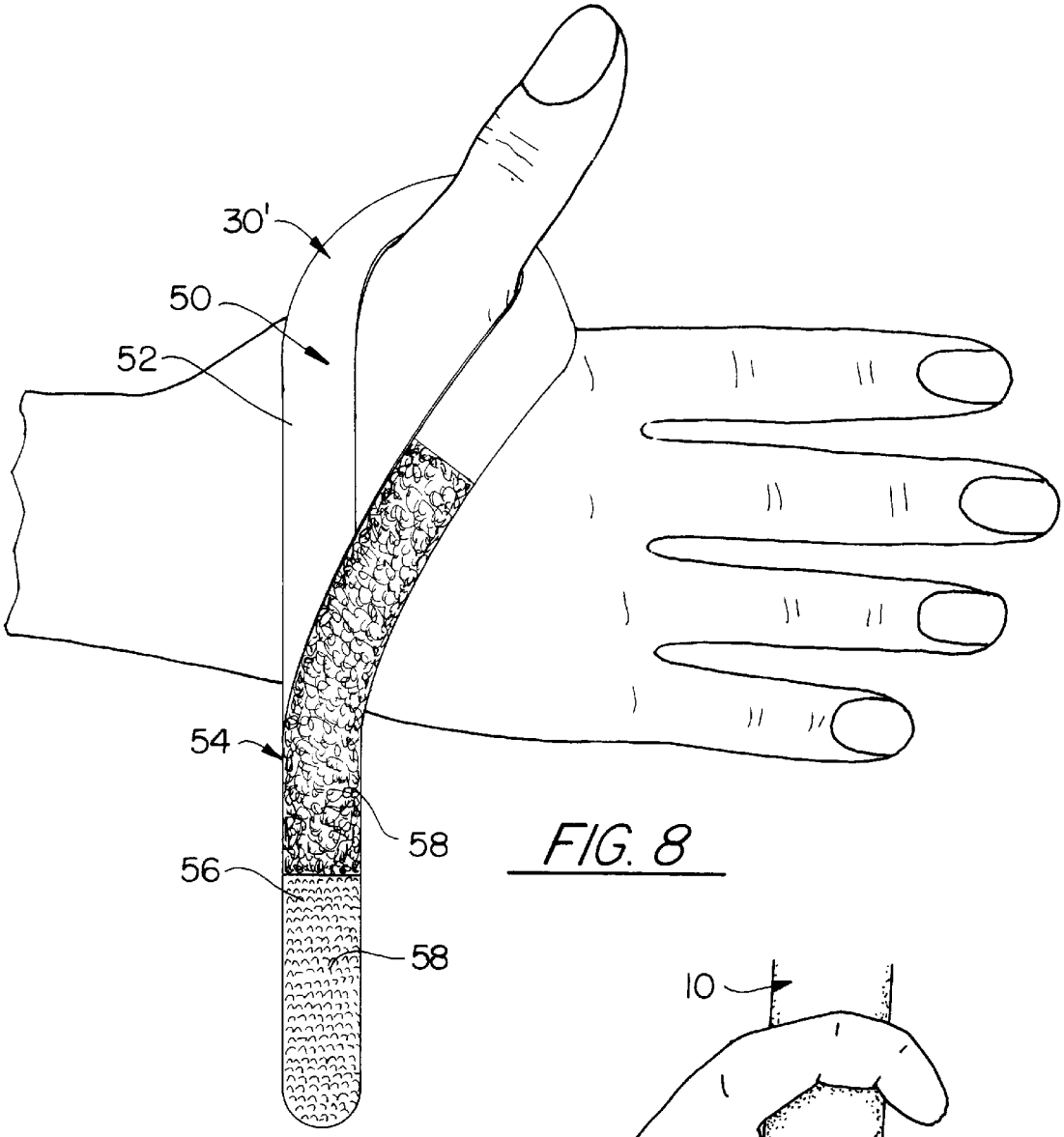
FIG. 8 is a perspective view of another embodiment of the hand strap, shown partially fitted to a player's hand and removed from the grip of the mallet.
Figure 9:
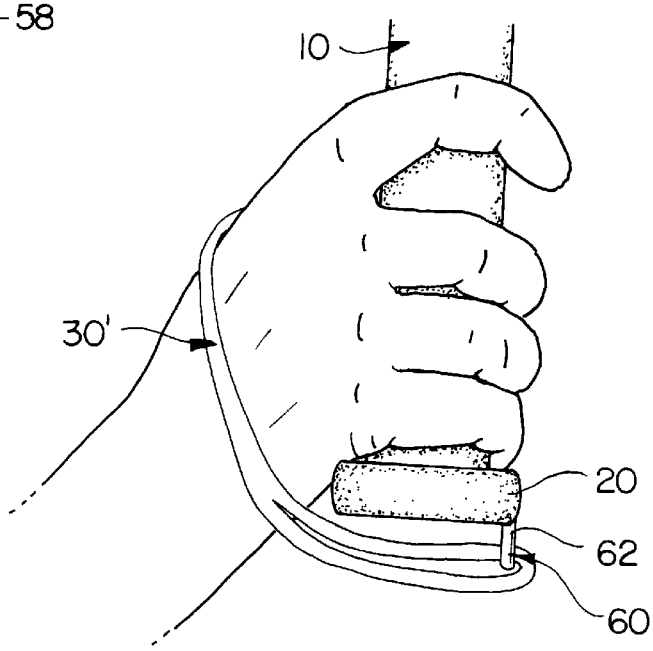
FIG. 9 is a perspective view showing the strap of FIG. 8 fitted snugly about a player's hand and secured to the grip of a polo mallet while the player is grasping the grip.

In another embodiment, as seen in FIGS. 8 and 9, the adjustable hand strap 30' includes a first portion 50 formed into a closed loop 52 and a second portion 54 defined by a tail 56 or length of strap extending from the loop. The loop 52 is formed with an initial twist so that when it is wrapped about the user's thumb, it lies flat against the back of the hand, with no twist, as seen in FIG. 8. The tail end 56 of the strap 30' is provided with hook and loop fastening means 58 which may extend partially about the closed loop portion of the strap, on the outer facing surface. To attach the strap 30' to the grip 10 of the polo mallet, the tail 56 is fitted through an elongate ring 62 of a strap securing fitting 60 attached to one side of the grip. Once fitted through the elongate ring 62, the tail end of the strap is folded back onto itself so that the hook and loop fastening means engage to secure the free tail end, thereby removing any slack and keeping the strap tight around the player's hand and between the player's hand and the grip.

Figure 11:
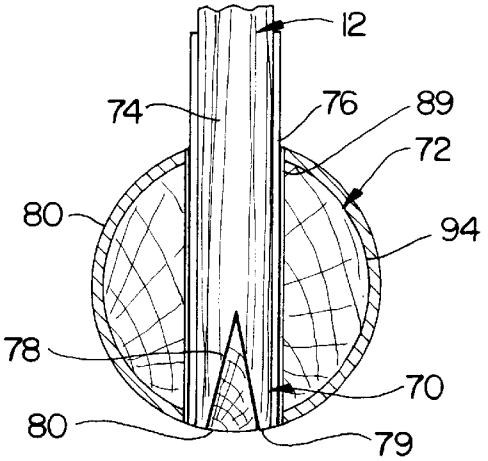
FIG. 11 is a sectional view taken along line 11—11 in FIG. 10.
Figure 12:
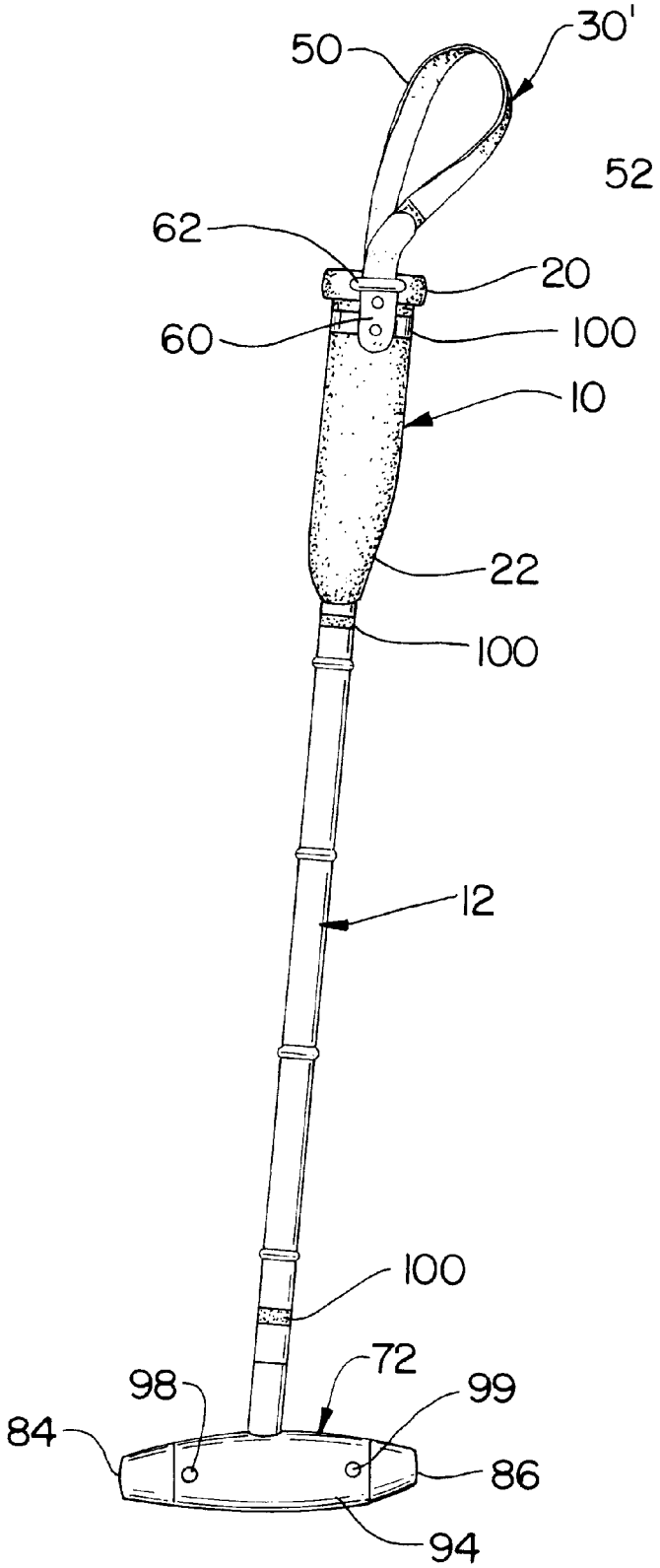
FIG. 12 is a perspective view of a polo mallet in accordance with the present invention showing the areas wherein weight is added to the mallet in order to balance the mallet in accordance with the method of the present invention.

Referring to FIG. 11, the improved polo mallet further includes a splice 70 for attaching the head 72 to the distal end zone 74 of the shaft 12. The splice, in accordance with the present invention, uses a high strength fabric material 76, such as KEVLAR, to strengthen the distal end of the shaft, while also adding weight to the lower portion of the mallet. In attaching the head to the shaft, using the splice of the present invention, a two part epoxy is mixed and then placed on the distal end zone of the cane shaft with a brush. Thereafter, the reinforcing splice material 76 is rolled onto the cane, effectively wrapping the entire distal end zone 74 (approximately the lower six inches of the shaft) in the splice material 76. Once the epoxy has dried, the mallet head 72 is fitted to the distal end zone 74 of the shaft.

There are two procedures for fitting the mallet head to the shaft in accordance with the method of the present invention. The first method is to cut a V-shape 78 into the lowermost distal end zone of the shaft, beginning at the distal end 79, before the splice material is applied thereto. Once the V-shape 78 has been cut, the reinforcing splice material is applied with the epoxy, as described above. Alternatively, the splice material can be glued to the distal end zone of the shaft, with the two part epoxy and, once the epoxy has dried, the V-shape can be cut into the distal end zone, beginning at the distal end. In either case, the distal end zone of the shaft is then fitted through a drilled bore in the center of the head until the distal end 79 is flush with the bottom surface of the head. A wedge 80 is then glued and hammered into the V-shape cut to cause the distal end zone surrounding the V-shape cut 78 to expand slightly. This creates friction which, together with an epoxy bond, is more than sufficient to hold the head tightly secured to the shaft. If it is necessary to replace the mallet head on the shaft, the KEVLAR can be chiseled off, sanded off, or removed with the use of acetone to dissolve the epoxy.

When applying the splice 70, in accordance with the method of the present invention, the cane shaft 12 is placed horizontal and rotated. A lathe can be used to perform this function. The slice material (e.g., KEVLAR thread) is pulled from a spool and applied to the distal end of the shaft, as the shaft is rotating. It is important to maintain tension on the composite material extending between the shaft and the spool. As the composite material is being applied to the shaft, the spool should be moved longitudinally so that the thread splice material is applied evenly, without gaps, along the entire length of the distal end zone of the shaft. Another method is to wrap a woven reinforcing material (e.g., KEVLAR fabric) about the distal end zone of the shaft, using a two-part epoxy to bond the material to the shaft. One to two layers of between 1 to 2 millimeters in thickness is sufficient. This may be preferable over the use of thread due to the added strength of a woven fabric.

The splice 70 of the present invention, as described above, is particularly useful to prevent what is known as "The Ringer," which is fatigue to the cane shaft that results from constant torquing of the head when striking a ball or inadvertently hitting the ground. The splice 70 further protects the distal end zone of the shaft (just above the mallet head) from damage if the shaft is struck by mallets of other players.

Figure 10:
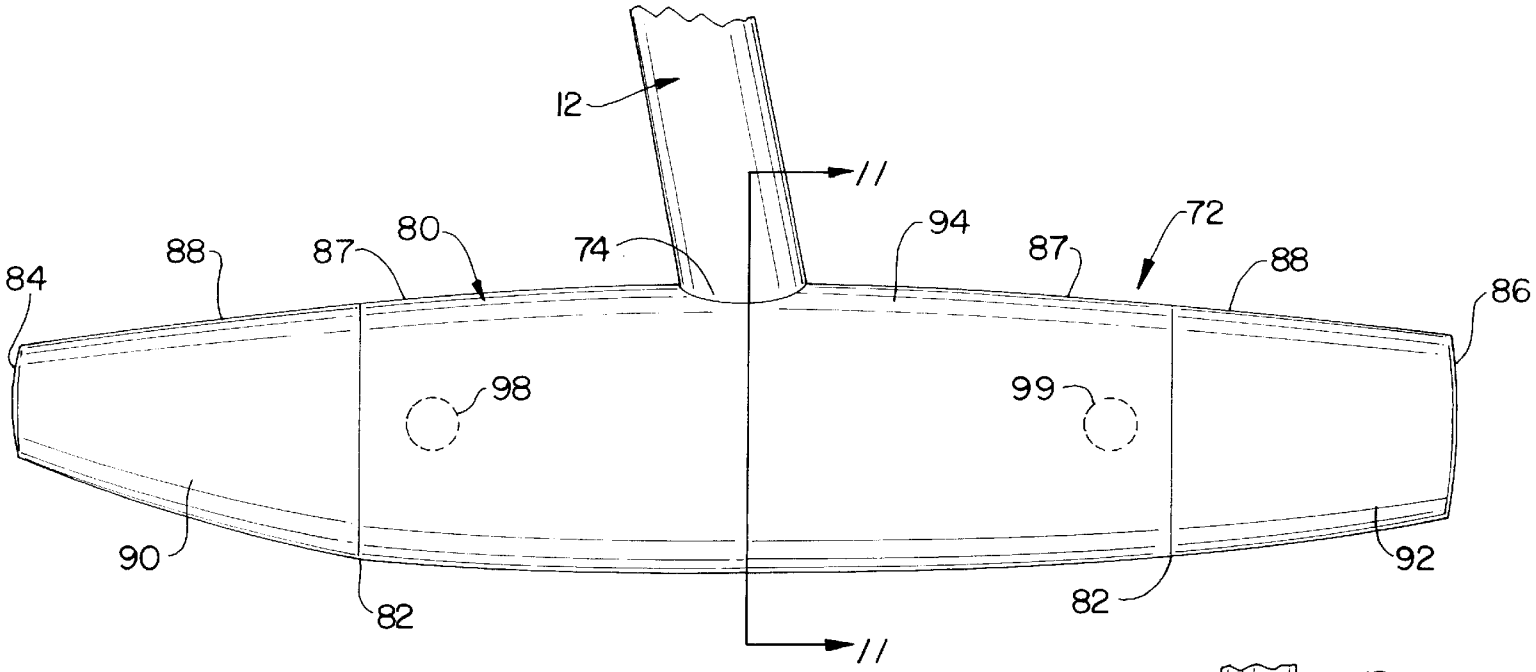
FIG. 10 is a side elevation, in partial section, showing a head of a polo mallet fitted to the distal end of the shaft in accordance with another embodiment of the invention, wherein the head is provided with a sleeve of ballistic material to increase hardness.

Referring to FIGS. 10 and 11, an improved polo mallet head 72 is shown in accordance with the present invention. In particular, the mallet head 72 is provided with a reinforcing material 80 (e.g., ballistic material) about its outer surface, to thereby increase the hardness of the outer surface of the mallet head. The increased hardness results in less absorption of impact when striking a ball, thereby producing a greater distance of flight of the ball, as well as a longer roll once the ball has landed. The reinforcing material 80 (e.g., KEVLAR) or carbon fiber is applied to the head by first milling the exterior surface of the wood head 72 about the central zone 82, approximately 15 centimeters long, equally spaced between the opposite ends 84, 86 of the head 72. This central zone 82 is milled or torn to reduce the diameter in the central zone by approximately 2 millimeters, thus producing a recessed area about the head, throughout the central zone, which is approximately 1 millimeter deep. Thereafter, a sheet of fabric reinforcing material 80, such as KEVLAR or carbon fiber, is wrapped about the recessed central zone. It is important that the reinforcing material be as close to 1 millimeter in thickness as possible, so that the resultant exterior surface 87 of the central zone is flush with the exterior surface 88 at the opposite end zones 90, 92. The reinforcing material is glued to the central zone of the head with a two part epoxy. Once the epoxy has cured, the bore 89 is drilled through the head 72 for receipt of the shaft 12. The result is a composite material tube 94 about the central zone of the head, approximately 15 centimeters in length. This composite material tube 94 protects the wood head from damage from the environment, as well as impact with other objects, such as other mallet heads and the ball. As mentioned above, the composite material tube produces increased hardness, thereby reducing the amount of absorption of impact with the ball, resulting in greater distance of ball travel in the air and on the roll, when striking the ball in the central zone.

In another embodiment, the improved mallet head 72 is formed from a block of composite material, such as polyurethane foam. The block of composite material is milled and shaped to the configuration of a traditional polo mallet head, as seen in FIG. 10. However, the head, formed from the milled composite material is slightly smaller than the traditional mallet head (approximately 1–2 millimeters in overall dimension). After milling the block of composite material, the entire exterior surface of the milled head is covered with a reinforcing material such as carbon fiber or KEVLAR. This provides an increased hardness, which is significantly harder than the wood used to manufacture the traditional polo mallet head. The increased hardness of the improved polo mallet head, in accordance with the present invention, minimizes the amount of absorption upon impact with the ball, resulting in greater travel distance of the ball, as described above in connection with the previous embodiments. The outer shell of carbon fiber or KEVLAR further provides protection against damage as a result of impact with other objects, such as opposing players' mallet heads, as well as damage from exposure to moisture or dryness.

A method of balancing polo mallets in accordance with the present invention enables a plurality of polo mallets to be replicated in accordance with the specification of individual polo players. The method of balancing the polo mallet includes first identifying an ideal polo mallet, or specification mallet, according to the individual player's preferences and needs. This includes identifying mallet weight, shaft flexibility, balance and overall length. In order to select the specification mallet, a test session is performed on the field with the player. The object of the test is to experiment with different weights and balances in order to find the ideal polo mallet (specification mallet) that will match the player's specifications. Once the player has identified a polo mallet which possesses the desired balance, weight, flexibility and feel, the method of the present invention is employed to produce the same characteristics in other polo mallets so that the polo player can maintain a supply of polo mallets having identical specifications. A subsequent selection of mallets that are compatible in weight and flexibility to the selected specification mallet is then made. To balance the subsequently selected mallets in order to replicate the specification mallet, the subsequently selected mallets are first weighed. The weight of each of the subsequently selected mallets is then compared to the weight of the specification mallet. It is important that the subsequently selected mallets weigh the same or less than the specification mallet. The difference in weight between the mallet to be balanced and the specification mallet will be the amount of weight that will have to be added when balancing the subsequently selected mallet. The distribution and location of this weight is dependent upon the location of the balance point on the specification mallet. Thus, it is necessary to first identify the location of the balance point along the shaft of the specification mallet prior to adding weight to the subsequently selected mallets. In order to determine the balance point on the specification mallet, the specification mallet is placed transversely on a balance beam (i.e., perpendicular to the balance beam). The balance point is a measurement from the head to the point along the shaft where the mallet balances on the beam. This balance point is marked on the specification shaft with a designated color. Thereafter, each of the subsequently selected mallets are marked with the specification balance point, which is the distance from the head to the point of the shaft where the specification mallet balanced. The subsequently selected mallets are then placed on the balance beam, on the specification balance point mark. The specific balance point of each of the subsequently selected mallets can also be determined by balancing each of the mallets on the balance beam prior to adding weight. This can help determine the location where weight will need to be added in order to move the original balance point to the specification balance point. Each of the subsequently mallets will most likely have a different amount of weight that needs to be added in order to meet the specification weight. Thus, the specific amount of weight to be added must be separated and allocated to each of the mallets. Then, by distributing the weight along the head, shaft and grip of each of the mallets, the original balance point can be moved until it matches the specification balance point. All information of weight, balance point, and weight distribution on the mallet, with precise detail of the position and amount of weight added, are recorded on the player's specification log for each individual mallet.

When adding weight to the head 72, the head is first marked within 4 to 10 centimeters from the opposite ends 84, 86 on the right face of the mallet head. Thereafter, two chambers 98, 99 are drilled on the head, at the locations where weight is to be added, equally spaced on opposite sides of the shaft. A weight element, such as a lead bar, is then inserted within each of the chambers and deformed using a hammer and tap. The chambers are then filled with a mixture of epoxy and wood dust and sanded to provide a flush finish. Adding weight at these locations, preferably 6 or more grams, has the effect of increasing the "sweet spot," which is the area on the face of the head where a solid impact, with no vibration or torque, is made when striking the ball. This helps to lessen torque on the head (tendency to twist) when the ball is hit off-center. The added weight to the mallet head also produces increased shot accuracy and greater shot distance in the air and on the roll of the ball.

Figure 4:
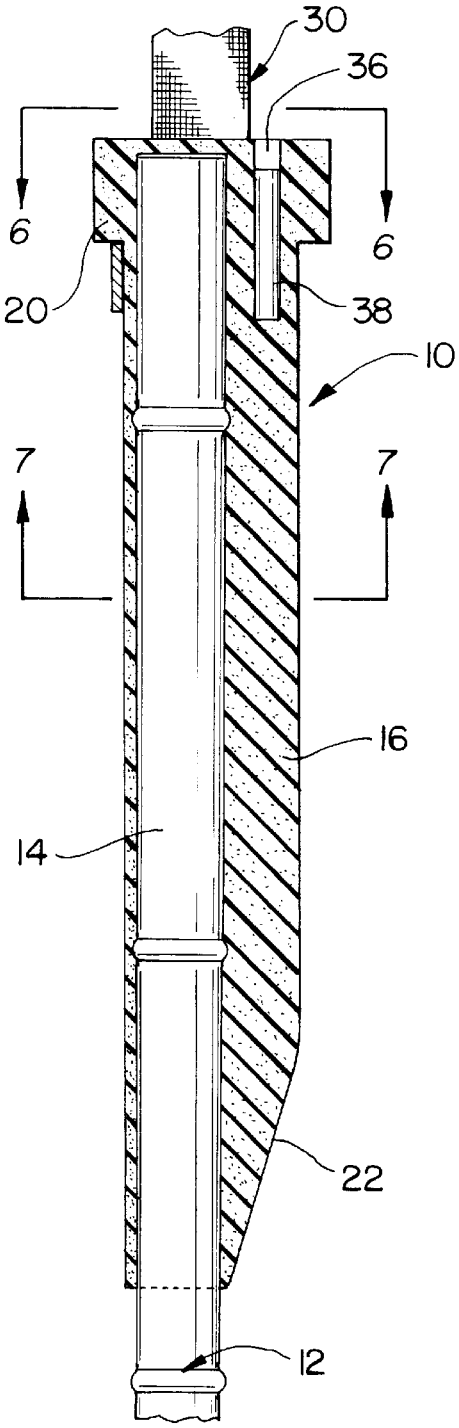
FIG. 4 is a sectional view taken along the plane of the line 4—4 of FIG. 3.

Lead tape 100 is used if necessary to add weight to the shaft. A combination of lead tape and weights can be applied to the grip. This can be done by inserting weight elements (e.g., lead bars) into the bore 36 formed in the grip 10, as shown in FIG. 4. Further, lead tape 100 may be wrapped about the grip, at a location which has the effect of moving the balance point to the specification balance point on the shaft. Once all of the weight has been added, the mallet is weighed and balanced a final time to assure that the total weight and balance point match the specification weight and balance point.

While this invention has been shown and described in accordance with preferred and practical embodiments thereof, it is recognized that departures may be made from the invention as disclosed herein, without limitation, and within the spirit and scope of the following claims.

What is claimed is:

1. A grip for use on a handle end of a shaft of a polo mallet, said grip comprising:

an elongate body integrally formed of a resilient, composite material and adapted to be molded about said handle end of said polo mallet shaft and having a predetermined, reproduceable size and configuration, said elongate body including a distal end zone with a distal end, a proximal end zone with a proximal end, a central zone extending between said distal and proximal end zones, and an exterior surface;

said proximal end zone of said body being enlarged relative to said central zone to define a knob including an outer peripheral surface, a shoulder adjacent said central zone, and an end opposite said shoulder and defining said proximal end of said body;

a hand strap structured and disposed to be secured to a user's hand when grasping said grip and said hand strap including opposite ends;

means for removably attaching said hand strap to said body and including:

a spring clip having opposite arm members;

loop means formed at said opposite ends of said hand strap for receipt of said arm members of said spring clip therethrough; and said spring clip being structured and disposed for removable attachment about said exterior surface of said body below said knob with said respective arm members being received through said loop means and urged inwardly against said exterior surface of said body, on opposite sides thereof, to hold said opposite ends of said hand strap on said grip body;

balance means structured for removable receipt of weight elements adapted for selectively and adjustably balancing the polo mallet, said balance means including at least one chamber formed within said body and including a channel having an open end adapted for inserting and removing the weight elements therein.

2. A grip for use on a handle end of a shaft of a polo mallet, said grip comprising:

an elongate body integrally formed of a resilient, composite material and adapted to be molded about said handle end of said polo mallet shaft and having a predetermined, reproduceable size and configuration, said elongate body including a distal end zone with a distal end, a proximal end zone with a proximal end, a central zone extending between said distal and proximal end zones, and an exterior surface;

said proximal end zone of said body being enlarged relative to said central zone to define a knob including an outer peripheral surface, a shoulder adjacent said central zone, and an end opposite said shoulder and defining said proximal end of said body;

a hand strap structured and disposed to be secured to a user's hand when grasping said grip;

said hand strap including a first portion formed into a closed loop and a second portion extending from said first portion and defining a tail;

means for adjustably tightening said hand strap about a user's hand and including hook and loop fastening means for releasably attaching said tail to said hand strap; and means for removably attaching said hand strap to said body and including an elongate ring fitted to said body, at said proximal end zone, said elongate ring being structured and disposed for receipt of said tail of said hand strap therethrough, said tail being structured to be pulled taut after passage through said elongate ring and folded back onto itself, and said tail being releasably attachable to said hand strap by said hook and loop fastening means to thereby define said means for adjustably tightening said hand strap.

* * * * *